US006029274A

United States Patent [19]

Welchel et al.

[11] Patent Number: 6,029,274

[45] Date of Patent: Feb. 29, 2000

[54] PROTECTIVE GARMENT AND METHOD OF MANUFACTURE

[75] Inventors: Debra Nell Welchel; Alan Edward Wright; Jay Amedee Poppe, all of Woodstock; Vivian Gray, Marietta, all of Ga.

[73] Assignee: Kimberly-Clark Worldwide, Inc., Neenah, Wis.

[21] Appl. No.: 09/110,654

[22] Filed: Jul. 7, 1998

Related U.S. Application Data

[60] Provisional application No. 60/056,984, Aug. 26, 1997.

[51] Int. Cl.[7] ..... A41B 1/12; A41D 1/12

[52] U.S. Cl. ..... 2/69; 2/71

[58] Field of Search ..... 2/69, 69.5, 71, 2/79, 86, 72, 114, 456, 457, 458

[56] References Cited

U.S. PATENT DOCUMENTS

| | | | |
|---|---|---|---|
| 762,363 | 6/1904 | Talcott . | |
| 1,421,162 | 6/1922 | Buckley . | |
| 1,783,572 | 12/1930 | Johnson . | |
| 3,144,659 | 8/1964 | Matthews . | |
| 4,257,127 | 3/1981 | Kaupin et al. | 2/75 |
| 4,412,358 | 11/1983 | Lavender | 2/412 |
| 4,432,099 | 2/1984 | Grick et al. | 2/412 |
| 4,459,704 | 7/1984 | Sears et al. . | |
| 4,670,913 | 6/1987 | Morell et al. | 2/227 |
| 4,720,415 | 1/1988 | Vander Wielen et al. | 428/152 |
| 5,052,052 | 10/1991 | Gilford et al. | 2/2 |
| 5,140,721 | 8/1992 | Kauffeld | 2/2.1 R |
| 5,377,693 | 1/1995 | Loper et al. | 128/845 |
| 5,487,189 | 1/1996 | Bell | 2/79 |
| 5,509,142 | 4/1996 | Connell et al. | 2/79 |
| 5,613,378 | 3/1997 | Popa et al. . | |
| 5,624,729 | 4/1997 | Cohen et al. | 428/90 |
| 5,669,079 | 9/1997 | Morgan | 2/414 |
| 5,727,255 | 3/1998 | Minks . | |
| 5,729,832 | 3/1998 | Grilliot et al. | 2/23 |

FOREIGN PATENT DOCUMENTS

| | | |
|---|---|---|
| 0672357A2 | 9/1995 | European Pat. Off. . |
| 1577493 | 8/1969 | France . |
| 2 199 233 | 7/1988 | United Kingdom . |
| 94/12065 | 6/1994 | WIPO . |

OTHER PUBLICATIONS

Abstract; Patent DE 3900 694 A; Greenfog GMBH; Dated: Jul. 19, 1990.

Abstract; Patent DT 25 43 046; Seidl L.; Dated: Apr. 7, 1977.

Abstract; Patent DT 27 03 538; Porner M.J.; Dated: Aug. 11, 1977.

PCT Counterpart International Search Report mailed Nov. 19, 1998.

*Primary Examiner*—John J. Calvert
*Assistant Examiner*—Shirra L Jenkins
*Attorney, Agent, or Firm*—Karl V. Sidor

[57] ABSTRACT

A protective garment without front facing seams. The protective garment contains a body piece composed of a single seamless sheet of material. The body piece has a right body side and a left body side. Each body side includes a first and second leg edge, a torso edge and a top body side edge extending approximately half-way across each body side from the respective torso edge. The body piece also includes a right sleeve portion and a left sleeve portion. Each sleeve portion has a first and second sleeve edge, and a top sleeve portion edge. Generally speaking, the garment's construction includes approximately five seams and a closure. The closure joins the torso edge of right body side to the torso edge of the left body side to form a resealable opening at a rear face of the garment. Sleeve seams join the first sleeve edges to the second sleeve edges on each sleeve portion and inseams join the first leg edges to the second leg edges on each body side. A back seam joins the top sleeve portion edge of the right sleeve portion at approximately the top body side edge of the right body side and the top sleeve portion edge of the left sleeve portion at approximately the top body side edge of the left body side. The back seam is located at the rear face of the garment. Also disclosed is a method of making a protective garment without front facing seams.

25 Claims, 4 Drawing Sheets

PROTECTIVE GARMENT AND METHOD OF MANUFACTURE

This Appln claims the benefit of U.S. Provisional Appln. Ser. No. 60/056,984 filed Aug. 26, 1997.

FIELD OF THE INVENTION

The present invention relates to protective apparel. The present invention also relates to a process for making protective apparel.

BACKGROUND

There are many types of limited use or disposable protective garments and apparel designed to provide barrier properties. One type of protective garment is protective coveralls. Coveralls can be used to effectively seal off a wearer from a harmful environment in ways that open or cloak style garments such as, for example, drapes, gowns, shirts, pants and the like are unable to do. Accordingly, coveralls have many applications where isolation of a wearer from a work environment is desirable. For example, it may be desirable to isolate a worker from a hazardous environment. As another example, it may be desirable to isolate an environment (e.g., a clean room) from a worker.

For a variety of reasons, it is undesirable for hazardous liquids and/or pathogens which may be carried by liquids to pass through protective apparel. It is also highly desirable to use protective apparel to isolate persons from dusts, powders, and other particulates which may be present in a work place or accident site. Generally speaking, protective apparel relies on the barrier properties of the fabrics used in their construction. Some of these fabrics may even have received treatments to enhance barrier properties. However, barrier performance of protective apparel also depends on the design and construction of the garment. Apparel containing many seams may be unsatisfactory, especially if the seams are located in positions where they may be subjected to stress and/or direct contact with hazardous substances. Seams located at the front of apparel are particularly susceptible to stress and/or direct contact with hazardous substances. For example, seams that join sleeves or legs to the body portion of protective coveralls are often subjected to stress. Moreover, sleeve seams in the front of coveralls and seams about the chest are at locations of frequent accidental splashing, spraying and/or other exposures.

After use, it can be quite costly to decontaminate protective apparel that has been exposed to hazardous substances. Thus, it is important that protective apparel be inexpensive so as to be disposable. Generally speaking, protective garments are made from barrier materials/fabrics engineered to be relatively impervious to liquids and/or particulates. The cost of such materials as well as the garment's design and construction are important factors affecting cost. Desirably, all of these factors should be suited for the manufacture of protective garments at such low cost that it may be economical to discard the garment after only a single use.

Protective garments must be worn correctly to reduce the chance of exposure. Workers are more likely to wear protective garments (e.g., protective coveralls) properly if the garments are comfortable. One way to increase comfort is to have the garment fit well. Protective garments (e.g., protective coveralls) containing many separate panels, pieces, dissimilar materials and/or elastic components may tend to fit well but are generally more complex and difficult to manufacture quickly. Complex and relatively inefficient manufacturing processes can eliminate the cost advantages provided by inexpensive materials. Moreover, an increased number of seams and/or the presence of dissimilar materials can increase the chance of exposure.

Thus, a need exists for inexpensive protective garments such as, for example, protective garment having desirable barrier properties, a reduced number of seams and no seams located at the front face of the garment. There is still a need for such protective garments suited for high-speed manufacturing and converting processes. For example, a need exists for protective garments manufactured from a single seamless sheet of an inexpensive barrier material such that the garments are relatively impermeable to liquids and/or particulates and so inexpensive as to be disposable while also having a reduced number of seams and no seams located at the front face of the garments.

DEFINITIONS

As used herein, the term "nonwoven web" refers to a web that has a structure of individual fibers or filaments which are interlaid, but not in an identifiable repeating manner. Nonwoven webs have been, in the past, formed by a variety of processes known to those skilled in the art such as, for example, meltblowing, spunbonding and bonded carded web processes.

As used herein, the term "spunbonded web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. No. 5,213,881, entitled "A Nonwoven Web With Improved Barrier Properties", incorporated herein by reference in its entirety.

As used herein, the term "sheet" refers to a material that may be a film, nonwoven web, woven fabric or knit fabric or combinations of the same.

As used herein, the term "disposable" is not limited to single use articles but also refers to articles that can be discarded if they become soiled or otherwise unusable after only a few uses.

As used herein, the term "machine direction" refers to the planar dimension of a nonwoven fibrous web which is in the direction of travel of the forming surface onto which fibers are deposited during formation of the web.

As used herein, the term "cross-machine direction" refers to the planar dimension of a nonwoven fibrous web which is in the direction that is perpendicular to the machine direction defined above.

As used herein, the term "liquid resistant" refers to material having a hydrostatic head of at least about 25 centimeters as determined in accordance with the standard hydrostatic pressure test AATCC TM No. 127-1980.

As used herein, the term "breathable" refers to material having a Frazier porosity of at least about 25 cubic feet per minute per square foot (cfm/ft$^2$) as determined in accordance with the standard Frazier porosity test Federal Test Method 5450, Standard no. 191A or a Moisture Vapor Transmission Rate (MVTR) of at least about 500 grams per square meter per 24 hours (g/m$^2$/24 h) as determined in accordance with the standard MVTR test method ASTM E96-80.

As used herein, the term "particle resistant" refers to a fabric having a useful level of resistance to penetration by particulates. Resistance to penetration by particulates may be measured by determining the air filter retention of dry particles and can be expressed as a particles holdout efficiency. More specifically, particle hold-out efficiency refers to the efficiency of a material at preventing the passage of particles of a certain size range through the material. Particle holdout efficiency may be measured by determining the air filter retention of dry particles utilizing tests such as, for example, IBR Test Method No. E-217, Revision G (Jan. 15, 1991) performed by InterBasic Resources, Inc. of Grass Lake, Mich. Generally speaking, a high particle holdout efficiency is desirable for barrier materials/fabrics. Desirably, a particle resistant material should have a particle holdout efficiency of at least about 40 percent for particles having a diameter greater than about 0.1 micron.

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

The problems described above are addressed by a protective garment having fewer seams and no front facing seams.

The disposable protective garment may be in the form of coveralls containing a body piece composed of a single seamless sheet of material. The body piece has a right body side and a left body side. Each body side includes a first and second leg edge, a torso edge and a top body side edge extending approximately half-way across each body side from the respective torso edge. The body piece also includes a right sleeve portion and a left sleeve portion. Each sleeve portion has a first and second sleeve edge, and a top sleeve portion edge.

Generally speaking, the garment's construction includes approximately five seams and a closure. The closure joins the torso edge of right body side to the torso edge of the left body side to form a resealable opening at a rear face of the garment. In such a configuration, the protective garment can be described as rear-entry coveralls.

Sleeve seams join the first sleeve edges to the second sleeve edges on each sleeve portion and inseams join the first leg edges to the second leg edges on each body side. A back seam joins the top sleeve portion edge of the right sleeve portion at approximately the top body side edge of the right body side and the top sleeve portion edge of the left sleeve portion at approximately the top body side edge of the left body side. The back seam is located at the rear face of the garment. In some embodiments of the invention the back seam may be divided into two or more discrete seams.

In an embodiment of the invention, the closure means is adapted to join only a portion of the torso edge of right body side to only a portion of the torso edge of the left body side to form a resealable opening at a rear face of the garment. According to such an embodiment, the protective garment further include a seam joining a portion of the torso edge of the right body side to a portion of the torso edge of the left body side. This seam is located at the rear face of the garment.

In an aspect of the invention, the protective garment may be adapted to be liquid resistant, particle resistant and/or breathable.

The seamless sheet of material used to form a body piece may be selected from a bonded carded web, a web of spunbonded fibers, a web of meltblown fibers, and a film. The seamless sheet of material may be formed from a polymer selected from polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins, and mixtures and blends of the same. If the seamless sheet of material is a polyolefin, it may be selected from polyethylene, polypropylene, polybutene, ethylene copolymers, propylene copolymers and butene copolymers.

The seamless sheet of material used to form a body piece may be a laminate. For example, the seamless sheet of material may be a laminate of two or more nonwoven webs. As a further example, the seamless sheet material may be a laminate of at least one web of spunbonded fibers and at least one web of meltblown fibers and mixtures thereof. The seamless sheet of material may also be a laminate composed of at least one nonwoven web and at least one film layer. Generally speaking, the film layer may range in thickness from about 0.25 mil to about 5.0 mil. For example, the film will have a thickness ranging from about 0.5 mil to about 3.0 mil. Desirably, the film will have a thickness ranging from about 1.0 mil to about 2.5 mil.

Exemplary film layers include films formed from polymers which may include polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins. If the film layer is made of a polyolefin, the polyolefin may be polyethylene, polypropylene, polybutene, ethylene copolymers, propylene copolymers and butene copolymers and blends of the above.

According to the invention, the seamless sheet of material may have a basis weight ranging from about 15 gsm (i.e., grams per square meter) to about 300 gsm. Desirably, the seamless sheet of material may have a basis weight ranging from about 20 gsm to about 75 gsm.

In another aspect of the invention, the protective garment may contain elasticizing means on portions of the garment at the wrists, waist, back, and/or ankles of a wearer. For example, the protective garment may contain elastic cuffs at the wrists and/or ankles and elastic strips or sections at the waist and/or back. Alternatively and/or additionally, elastic strips can be placed about the circumference of the outermost portion of the wrist opening and/or ankle openings of the garment. Other features may be included in the garment such as, for example, vents, zipper flaps, glove cuffs, boot cuffs, air inlets, hood cuffs, collars, and other mechanical fastening means and devices for attaching boots, hoods and/or gloves.

Generally speaking, the seams in the garment may be any suitable seams such as, for example, seams formed by sewing or stitching, taping, ultrasonic bonding, solvent welding, adhesives, thermal bonding and the like. The closure means may be any suitable closure mechanism such as, for example, zippers, button fasteners, clip fasteners, snap fasteners, hook and loop fasteners, resealable tapes, zip-lock fasteners, magnetic fasteners and the like.

The present invention also encompasses a method of making a protective garment having fewer seams and no front facing seams. The method of the present invention includes the steps of:

(1) providing a body piece composed of a seamless sheet of material, the body piece including: (a) a right body side and a left body side, each body side having a first and second leg edge, a torso edge and a top body side edge extending approximately half-way across each body side from the respective torso edge; and (b) a right sleeve portion and a left sleeve portion, each sleeve portion having a first and second sleeve edge, and a top sleeve portion edge; and (2) folding each body side substantially in half down their lengths; (3) attaching the first leg edge to the second leg edge for each body side; (4) folding each sleeve portion substantially in half down its length; (5) attaching the first sleeve edge to the second sleeve edge for each sleeve portion; (6) attaching the top sleeve portion edge of the right sleeve portion at approximately the top body side edge of the right body side and the top sleeve portion edge of the left sleeve portion at approximately the top body side edge of the left body side so that a seam is located at a rear face of the garment; and (7) attaching closure means adapted to join the torso edge of the right body side and the torso edge of the left body side to form a resealable opening at the rear face of the garment. According to the method of the present invention, these steps may be performed in any suitable order or sequence.

In an embodiment of the method of the present invention, the step of attaching closure means may be carried out to join only a portion of the torso edge of right body side to only a portion of the torso edge of the left body side to form a resealable opening at a rear face of the garment. In such case, the method may further include the step of attaching the remaining portion of the torso edge of the right body side to the remaining portion of the torso edge of the left body side so that a seam is at a rear face of the garment.

According to the method of the present invention, various portions of the garment may be joined or attached by sewing or stitching, ultrasonic bonding, solvent welding, adhesives, thermal bonding and similar techniques. The present invention also contemplates a process which includes the steps of attaching features such as, for example, vents, zipper flaps, glove cuffs, boot cuffs, air inlets, hood cuffs, collars, and other mechanical fastening means and devices for attaching boots, hoods and/or gloves.

The present invention also encompasses a front-entry, protective garment having fewer seams. For example, the protective garment may be front-entry, protective coveralls. This embodiment is also formed from a body piece that is a single seamless sheet of material as described above. That is, the body piece has a right body side and a left body side. Each body side includes a first and second leg edge, a torso edge and a top body side edge extending approximately half-way across each body side from the respective torso edge. The body piece also includes a right sleeve portion and a left sleeve portion. Each sleeve portion has a first and second sleeve edge, and a top sleeve portion edge.

Generally speaking, the front-entry garment's construction includes approximately six seams and a closure. More particularly, a seam joins the torso edge of right body side to the torso edge of the left body side. This seam is located at a rear face of the garment. Sleeve seams join the first sleeve edges to the second sleeve edges on each sleeve portion and inseams join the first leg edges to the second leg edges on each body side.

A back seam joins the top sleeve portion edge of the right sleeve portion at approximately the top body side edge of the right body side and the top sleeve portion edge of the left sleeve portion at approximately the top body side edge of the left body side. The back seam is located at the rear face of the garment. In some embodiments of the invention the back seam may be divided into two or more discrete seams. Closure means define an opening at a front face of the garment. The closure means resealably joins the edges of the opening together permitting front-entry into the garment.

The present invention also encompasses a method of making a front-entry, protective garment having fewer seams. The method includes the steps of:

(1) providing a body piece composed of a seamless sheet of material, the body piece including: (a) a right body side and a left body side, each body side having a first and second leg edge, a torso edge and a top body side edge extending approximately half-way across each body side from the respective torso edge; and (b) a right sleeve portion and a left sleeve portion, each sleeve portion having a first and second sleeve edge, and a top sleeve portion edge; and (2) attaching closure means to the seamless sheet of material at a front face of the garment; (3) folding each body side substantially in half down their lengths; (4) attaching the first leg edge to the second leg edge for each body side; (5) attaching the torso edge of the right body side and the torso edge of the left body side to form a seam at a rear face of the garment; (6) folding each sleeve portion substantially in half down its length; (7) attaching the first sleeve edge to the second sleeve edge for each sleeve portion; (8) attaching the top sleeve portion edge of the right sleeve portion at approximately the top body side edge of the right body side and the top sleeve portion edge of the left sleeve portion at approximately the top body side edge of the left body side so that a seam is located at a rear face of the garment; and (9) cutting the seamless sheet of material at the closure means to create an opening at the front face of the garment that can be resealably joined by the closure means. According to the method of the present invention, these steps may be performed in any suitable order or sequence.

DETAILED DESCRIPTION

Figure 1:
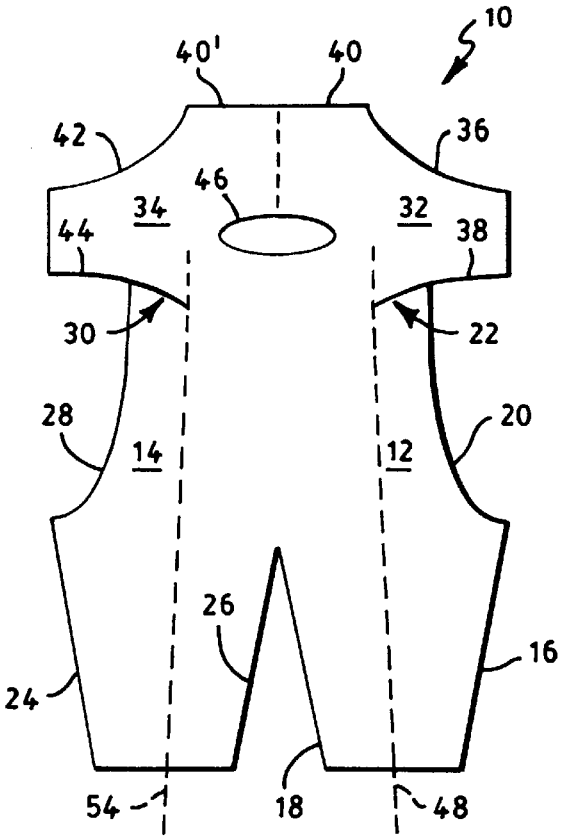
FIG. 1 is an illustration of an exemplary piece of seamless material used in the manufacture of an exemplary protective garment.

The present invention is directed to a protective garment. FIG. 1 is an illustration of a seamless sheet of material that forms a body piece 10 of the protective garment such as, for example, coveralls, an encapsulation suit, a respiratory suit or the like. The body piece 10 includes a right body side 12 and a left body side 14. The right body side 12 has a first leg edge 16 and a second leg edge 18. The right body side 12 also has a torso edge 20 and a top body side edge 22 that extends approximately half-way across the right body side 12 beginning at the torso edge 20 and extending to the interior of the body piece 10 and up to about a fold line 48.

The left body side 14 has a first leg edge 24 and a second leg edge 26. The left body side 14 also has a torso edge 28 and a top body side edge 30 that extends approximately half-way across the left body side 14 beginning at the torso edge 28 and extending to the interior of the body piece 10 and up to about a fold line 54.

The body piece 10 also includes a right sleeve portion 32 and a left sleeve portion 34. The right sleeve portion 32 has a first sleeve edge 36 and a second sleeve edge 38 and a top sleeve portion edge 40. The left sleeve portion 34 has a first sleeve edge 42 and a second sleeve edge 44 and may share the top sleeve portion edge 40 with the right sleeve portion 32. A neck opening 46 is located between the right sleeve portion 32 and the left sleeve portion 34. In an alternative embodiment of the invention, the right sleeve portion 32 and the left sleeve portion 34 may be separated by a cut in the seamless sheet material. This cut is illustrated in FIG. 1 by a broken line that extends from the neck opening 46 to the top sleeve portion edge 40.

Figure 2:
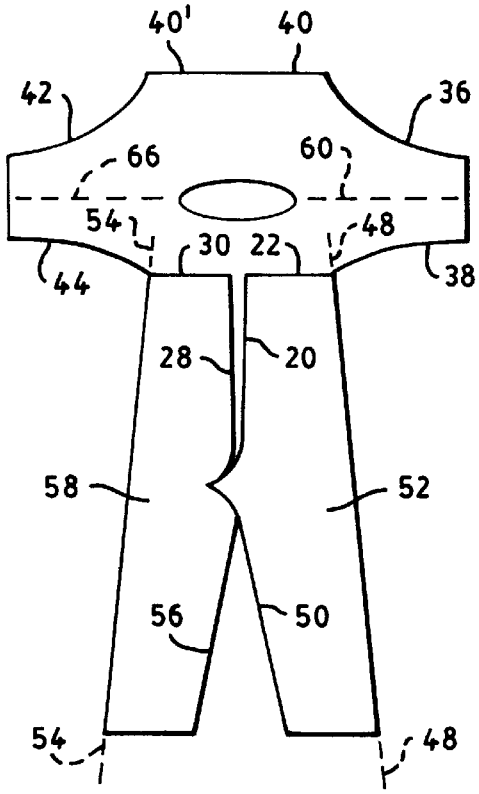
FIG. 2 illustrates a detail of an exemplary protective garment.

Folding the right body side 12 along a line 48 and joining the first leg edge 16 and the second leg edge 18 (see FIG. 1) at a right leg inseam 50 produces a right leg 52 as illustrated in FIG. 2. Folding the left body side 14 along a line 54 and joining the first leg edge 24 and the second leg edge 26 (see FIG. 1) at a left leg inseam 56 (see FIG. 1) produces a left leg 58 as illustrated in FIG. 2. Forming the right leg 52 and the left leg 58 brings the torso edges 20 and 28 together.

In one embodiment of the invention, the torso edges 20 and 28 remain unjoined at this stage and are later fitted with a closure means. This configuration is used for a rear-entry version of the finished protective garment (e.g., rear-entry, protective coveralls). In an alternative front-entry embodiment of the invention the torso edges 20 and 28 are joined to form a seam at the rear face of the finished protective garment.

Figure 3:
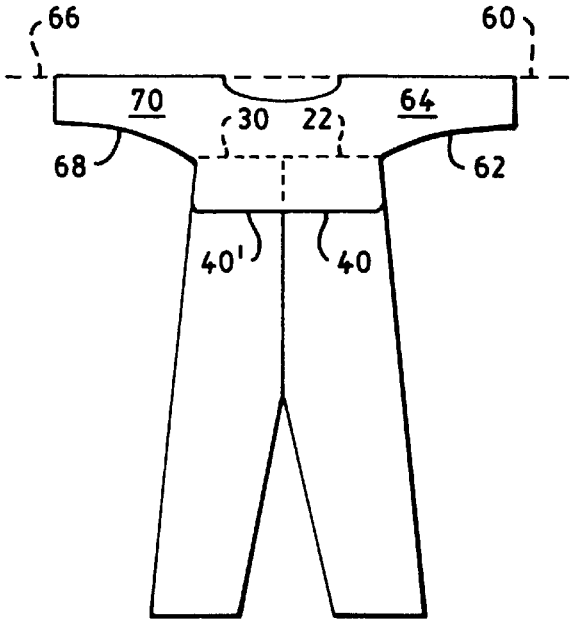
FIG. 3 illustrates a detail of an exemplary protective garment.

After these two leg/torso folds are made, the sleeve portions 32 and 34 are closed into sleeves. Folding the right sleeve portion 32 along a line 60 and joining the first sleeve edge 36 and the second sleeve edge 38 (see FIG. 2) at a right sleeve inseam 62 produces a right sleeve 64 as illustrated in FIG. 3. Folding the left sleeve portion 34 along a line 66 and joining the first sleeve edge 42 and the second sleeve edge 44 (see FIG. 2) at a left sleeve inseam 68 produces a right sleeve 70 as illustrated in FIG. 3.

After the two sleeve folds are made, the top back side of the garment is closed up. This is accomplished by joining the top sleeve portion edge 40 of the right sleeve portion 32 at approximately the top body side edge 22 of the right body side 12 and the top sleeve portion edge 40' of the left sleeve portion 34 at approximately the top body side edge 30 of the left body side 14 as illustrated in FIG. 3. As described above, the top sleeve portion edge 40 may be a continuous piece of material or it may be split.

Figure 4:
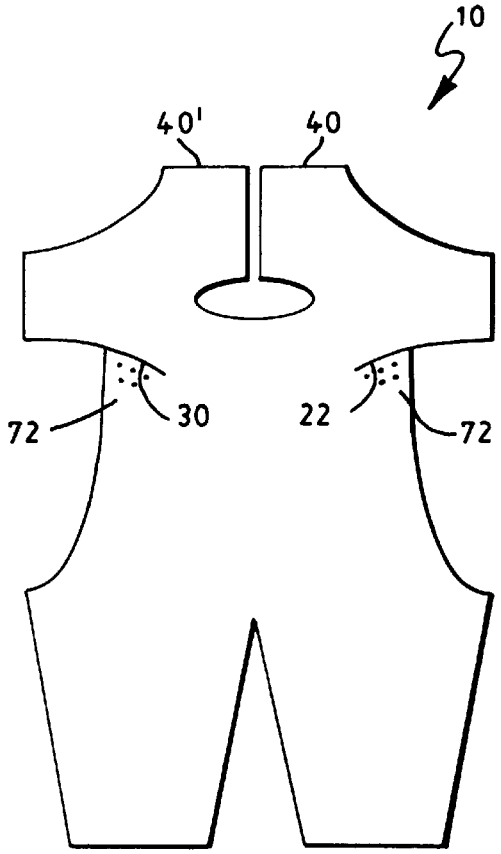
FIG. 4 illustrates a detail of an exemplary protective garment.
Figure 5:
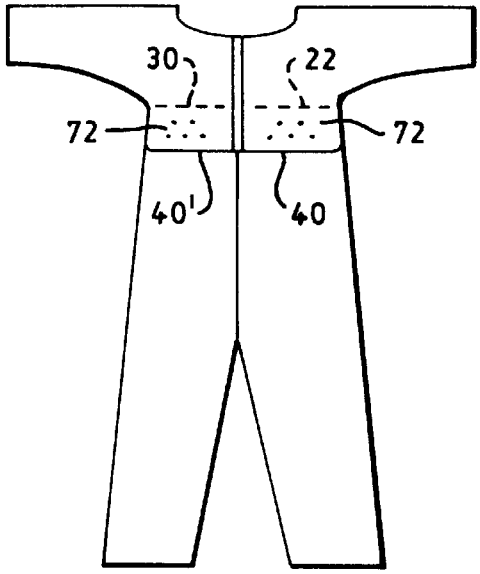
FIG. 5 illustrates a detail of an exemplary protective garment.

It is desirable for the top sleeve portion edge 40 (and 40') to overlap the top body side edges 22 and 30. However, it is contemplated that embodiments of the present invention may be practiced by joining the top sleeve portion edge to the top body side edges. The overlap of the top sleeve portion edge may be used to cover vent holes that can be inserted in the top body side edges. Referring to FIG. 4, there is shown an exemplary body piece 10 illustrating an optional split top sleeve portion 40 and 40' and vent holes 72 located about the top body side edges 22 and 30. As may be seen in FIG. 5 which is a view of the back of the garment, these vent holes 72 may be used to enhance ventilation of the garment with minimal risk of exposure because they are on the back of the garment and are covered by a flap of material created by the overlap of the top sleeve portion edge 40 (and 40') and the top body side edges 22 and 30. A portion of the back seam may be left open so that the vent holes 72 may vent properly.

Figure 6:
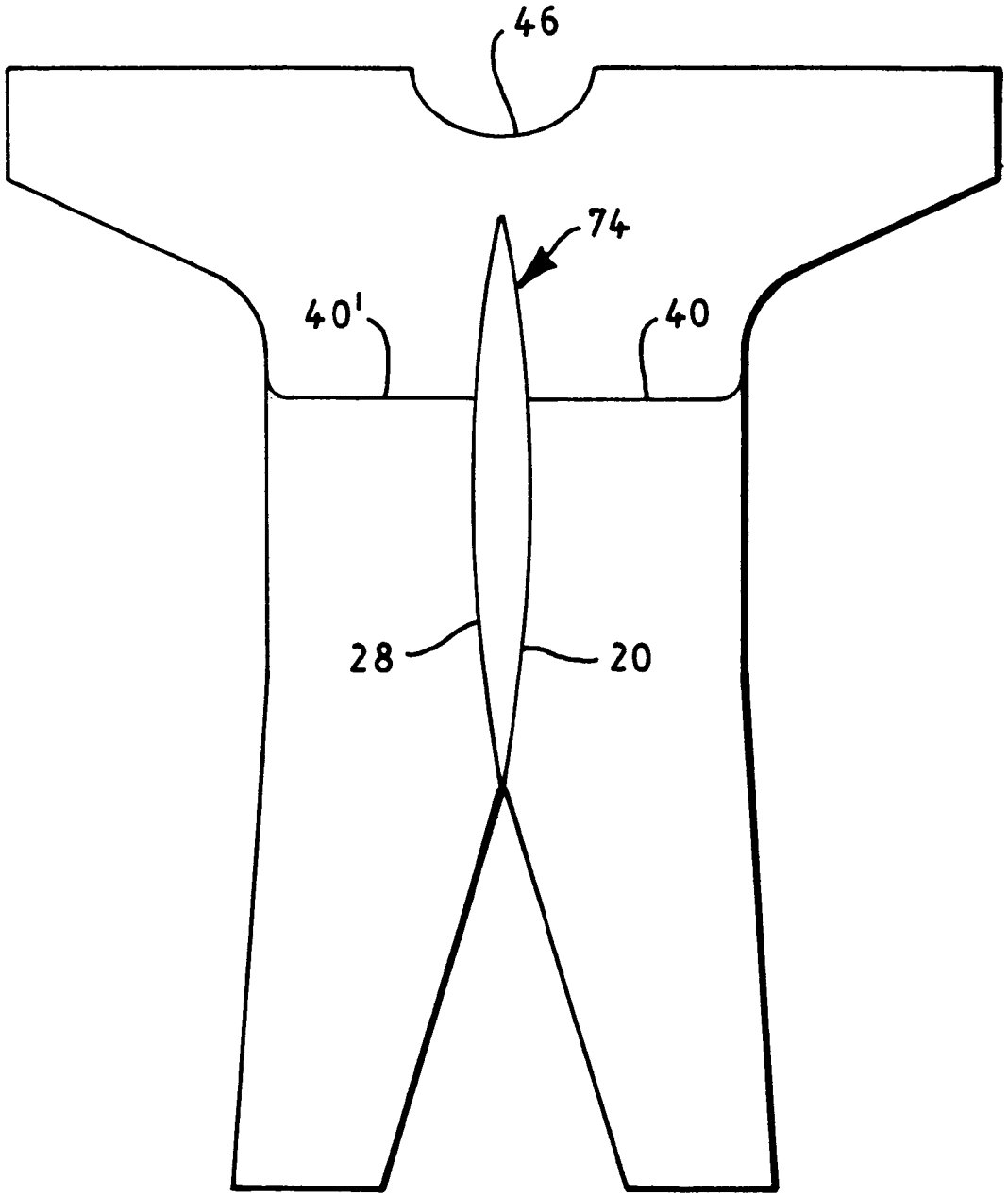
FIG. 6 illustrates a rear view of an exemplary protective garment.

FIG. 6 is also a view of the back of an exemplary garment illustrating a closure means 74 that is adapted to join the torso edges 20 and 28 and define a resealable opening at the back of the garment. The closure means (e.g., zipper, button fasteners, clip fasteners, snap fasteners, hook and loop fasteners and the like) 74 is attached to the respective torso edges 20 and 28. The resealable opening may extend past the top sleeve portion edge 40 (and 40') toward the neck opening 46. This configuration with the resealable opening in the back may be described as a rear-entry, protective garment (e.g., rear-entry, protective coveralls).

Figure 7:
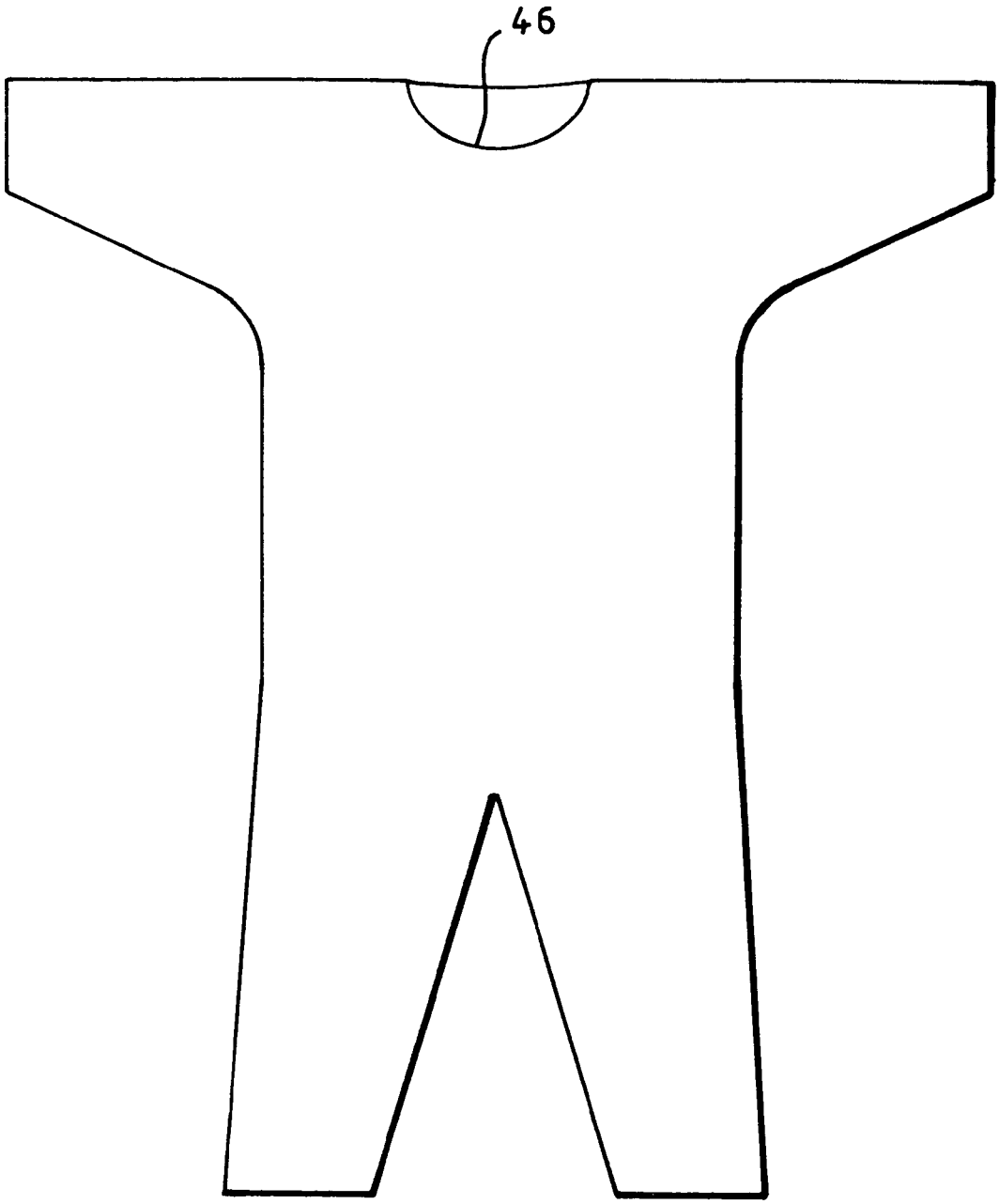
FIG. 7 illustrates a front view of an exemplary protective garment.

FIG. 7 is an illustration of the front side of the exemplary rear-entry protective garment shown in FIG. 6. It is important to note the absence of seams on the front side or face of the protective garment. Such a configuration is desirable to reduce the overall number of seams in the garment. The absence of front facing seams may help reduce the risk of exposure. Accidental splashings, sprayings, and/or other types of exposure often occur at the front of the garment. Front facing seams may also be snagged by equipment, tools, branches, debris and the like. Fewer seams may help simplify manufacture and make the garment easier to construct in high-speed manufacturing and converting processes.

Figure 8:
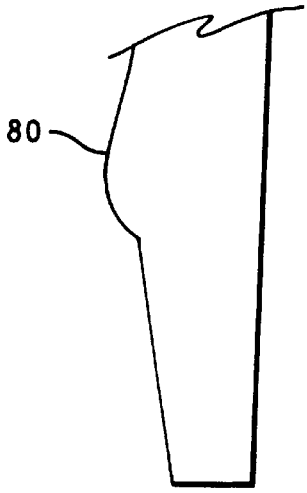
FIG. 8 illustrates a detail of an exemplary protective garment.

FIG. 8 is a detail of an exemplary garment of the present invention. In particular, FIG. 8 is a side view showing the contour 80 created by the curved configuration of the torso edges 20 and 28.

Other features may be added to the garment such as, for example, a collar, hood, expandable back, inlet port, boots and/or elastic cuffs at the wrists and/or ankles, vents, zipper flaps, glove cuffs, boot cuffs, air inlets, hood cuffs, and/or other mechanical fastening means and devices for attaching boots, hoods and/or gloves. For example, the neck opening may be fitted with a collar and/or hood. As another example, sleeves and legs may be fitted with elastic cuffs and/or other elastic means to ensure that they fit snugly against a wearer.

When the garments are configured so as to be entered from the rear (i.e., rear-entry), the protective garments' construction (e.g., protective coveralls' construction) contains approximately five seams and a closure. More particularly, there are two inseams on the legs, two sleeve seams, and a seam joining the top sleeve portion edge at approximately the top body side edges. A closure joins the respective torso edges. Of course, additional seams may be utilized.

When the garments are configured so as to be entered from the front (i.e., front-entry), the protective garments' construction (e.g., protective coveralls' construction) contains approximately six seams and a closure. More particularly, there are two inseams on the legs, two sleeve seams, a seam joining the top sleeve portion edge at approximately the top body side edges, and a seam joining the torso edges. In the front-entry configuration, the closure is fitted in the front of the garment. As noted for the rear-entry configuration, additional seams may be utilized.

Generally speaking, the manufacture of such garments may be in accordance with known automated, semi-automated, or hand assembly procedures. For example, attachment of the various portions of the garment may be achieved utilizing sewing or stitching, ultrasonic bonding, solvent welding, adhesives, thermal bonding and similar techniques. The closure means may be any suitable closure mechanism such as, for example, zippers, button fasteners, clip fasteners, snap fasteners, hook and loop fasteners, resealable tapes, zip-lock fasteners, magnetic fasteners and the like.

The order of manufacturing steps described above are believed to provide an efficient process for fabricating protective garments. However, it is contemplated that changes in the order of these steps may be made without departing from the spirit and scope of the present invention.

The seamless sheet of material used in the construction of the protective garment may be one or more bonded carded webs, webs of spunbonded filaments, webs of meltblown fibers. The seamless sheet material may also be one or more knit or woven materials. It is contemplated that the seamless sheet material may be one or more films.

The seamless sheet material (e.g., nonwoven webs, woven materials, knit materials or films) may be formed from polymers such as, for example, polyamides, polyolefins, polyesters, polyvinyl alcohols, polyurethanes, polyvinyl chlorides, polyfluorocarbons, polystyrenes, caprolactams, poly(ethylene vinyl acetates), ethylene n-butyl acrylates, and cellulosic and acrylic resins. If the nonwoven web is formed from a polyolefin, the polyolefin may be polyethylene, polypropylene, polybutene, ethylene copolymers, propylene copolymers and butene copolymers.

The seamless sheet material (e.g., the nonwoven webs, woven materials, knit materials or films) may have a basis weight ranging from about 15 gsm to about 300 gsm. For example, the seamless sheet material may have a basis weight ranging from about 25 gsm to about 100 gsm. Desirably, the seamless sheet material may have a basis weight ranging from about 20 gsm to about 75 gsm. An exemplary seamless sheet material that can be used in the manufacture of the protective garment of the present invention is a spunbonded polypropylene continuous filament web. This material can be formed utilizing a conventional spunbonding process and is available from the Kimberly-Clark Corporation, Neenah, Wis.

Another exemplary seamless sheet material is a high pulp content spunbonded continuous filament composite. Such a material may have a wide range of basis weights and can be composed of about 84 percent, by weight, pulp and about 16 percent, by weight, spunbonded polypropylene continuous filament web. This material can be formed essentially as described in U.S. Pat. No. 5,284,703, by C. H. Everhart, et al., entitled "High Pulp Content Nonwoven Composite Fabric", the entire contents of which is incorporated herein by reference.

Yet another exemplary seamless sheet material may be a through-air bonded carded web, such as, for example a through-air bonded carded web composed of about 60 percent, by weight, polyester staple fibers and about 40 percent, by weight, bi-component polyethylene/polyester staple fibers. The web may be formed utilizing conventional carding equipment and bonded utilizing a conventional heated through-air treatment which causes thermal bonding of the fibers.

Generally speaking, these seamless sheet materials may be treated to improve resistance to liquid and reduce static buildup. For example, these materials may be treated with compositions such as Zepel® and Zelec®, available from E. I. du Pont De Nemours.

Multiple layers of seamless sheet material may be joined into a seamless laminate and used to form garments having desirable barrier properties. Laminates can be formed by combining layers of seamless sheet materials with each other and/or forming or depositing layers of such materials on each other.

For example, useful multi-layer materials may be made by joining at least one web of meltblown fibers (which may include meltblown microfibers) with at least one spunbonded continuous filament web. An exemplary multilayer seamless material useful for making the protective garment of the present invention is a nonwoven laminated fabric constructed by bonding together layers of spunbonded continuous filaments webs and webs of meltblown fibers (which may include meltblown microfibers) and may also include a bonded carded web or other nonwoven fabric. This material is so inexpensive to produce that it may be considered to be a disposable material.

An exemplary three-layer fabric having a first outer ply of a spunbonded web, a middle ply of a meltblown web, and a second outer ply of a spunbonded web may be referred to in shorthand notation as SMS. The fibers and/or filaments in such fabrics may be polyolefins, polyesters, and polyamides. If polyolefins are used for the fibers and/or filaments, desirable polyolefins include polyethylene, polypropylene, polybutene, ethylene copolymers, polypropylene copolymers and butene copolymers, as well as blends and copolymers including the foregoing. Desirably, the polyolefin may be a random block copolymer of propylene and ethylene which contains about 3 percent or more, by weight, ethylene. The fibers and/or filaments may be formed from blends that contain various pigments, additives, strengthening agents, flow modifiers and the like. Such fabrics are described in U.S. Pat. Nos. 4,041,203, 4,374,888, and 4,753,843, the contents of which are incorporated herein by reference. Those patents are assigned to the Kimberly-Clark Corporation, the assignee of the present invention.

The multi-layer seamless sheet material may have a total basis weight of between about 15 gsm to about 300 gsm. For example, the multi-layer seamless sheet of material may have a basis weight ranging from about 40 gsm to about 175 gsm. Desirably, the multi-layer seamless sheet of material may have a basis weight ranging from about 50 gsm to about 150 gsm.

For example, the multi-layer seamless sheet of material may be a multi-layer nonwoven web of spunbond-meltblown-spunbond (SMS) construction in which each layer has a basis weight from about 9 gsm to about 70 gsm. Desirably, each layer may have a basis weight of from about 12 gsm to about 34 gsm. More desirably, each layer may have a basis weight of from about 14 gsm to about 27 gsm. To improve resistance to liquid and reduce static buildup, the material may also be treated with compositions such as Zepel® and Zelec®, available from E. I. du Pont De Nemours.

Exemplary multi-layer seamless sheet materials which may be used in the manufacture of the protective garment of the present invention include fabrics available from the Kimberly-Clark Corporation under the trade designation KLEENGUARD®. These fabrics are nonwoven laminated fabrics constructed by bonding together layers of spunbonded continuous filaments webs and webs of meltblown fibers (including meltblown microfibers). The fabrics may also include a bonded carded web or other nonwoven material. The KLEENGUARD® fabrics are typically composed of a first outer ply of a spunbonded polypropylene continuous filament web, a middle ply of a meltblown polypropylene web, and a second outer ply of a spunbonded polypropylene continuous filament web. These plies are joined together by conventional thermal bonding techniques utilizing heat and pressure. Such fabrics are described in U.S. Pat. Nos. 4,041,203, 4,374,888, and 4,753,843, the contents of which are incorporated herein by reference.

Other seamless sheet material may include, for example, TYVEK® materials and NOMEX® materials available from E. I. du Pont De Nemours and SARANEX® materials available from Dow Corporation. The seamless sheet material may also be selected from various rubberized fabrics (e.g., rubber-coated and/or rubber impregnated fabrics) as well as metal-coated films, fabrics and laminate materials.

Desirably, the seamless sheet material (e.g., nonwoven webs, woven materials, or knit materials) includes at least one film layer. Generally speaking, the film will have a thickness ranging from about 0.25 mil to about 5.0 mil. For example, the film will have a thickness ranging from about 0.5 mil to about 3.0 mil. Desirably, the film will have a thickness ranging from about 1.0 mil to about 2.5 mil.

An exemplary material which could be used for the manufacture of the protective garment of the present invention is laminated fabric constructed by bonding together at least one layer of a nonwoven web with at least one layer of a film.

Generally speaking, this laminate may have a basis weight ranging from about 15 gsm to about 300 gsm. For example, the laminate may have a basis weight ranging from about 20 gsm to about 150 gsm.

As another example, the laminate may have a basis weight ranging from about 20 gsm to about 75 gsm. Although the basis weight of the laminate will vary depending on the materials used, lower basis weight materials are desirable for comfort and conformability, and higher basis weight materials are desirable for toughness, durability and chemical resistance. The film-nonwoven web laminate construction permits combinations of materials providing high strength at relatively low basis weights and the design of the garment allows such strong and relatively unyielding materials to be used in a comfortable garment.

The films may be applied by extrusion coating the substrates and then passing the superposed materials through the nip of smooth calender rolls. The films may be formed so they would create a layer on the substrate having a desired thickness (excluding the substrate). Desirably, the films may be made of a polymer selected from polyamides, polyolefins, polyesters, polyvinyl alcohols, polyurethanes, polyvinyl chlorides, polyfluorocarbons, polystyrenes, caprolactams, poly(ethylene vinyl acetates), ethylene n-butyl acrylates, and cellulosic and acrylic resins. If the film is formed from a polyolefin, the polyolefin may be, for example, polyethylene, polypropylene, polybutene, ethylene copolymers, propylene copolymers and butene copolymers.

It is contemplated that the seamless sheet of material might include one or more pieces grafted together to form a larger piece of material. These grafted materials might be required for very large size garments in which the dimensions of the single body piece are larger than the width of the roll of seamless sheet material. That is, for cases where the pattern width is greater than the fabric width. While such grafted fabrics may present a seam at the location of the graft, the graft may be constructed more robustly than an ordinary seam to reduce the possibility of exposure even if the graft seam is present on the front of the garment.

While the present invention has been described in connection with certain embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A rear entry, protective garment comprising:

a body piece composed of a single seamless sheet of material, said body piece including:

a right body side and a left body side, each body side having a first and second leg edge, a torso edge and a top body side edge extending approximately halfway across each body side from the respective torso edge;

a right sleeve portion and a left sleeve portion, each sleeve portion having a first and second sleeve edge, and a top sleeve portion edge; and closure means adapted to join the torso edge of right body side to the torso edge of the left body side to form a resealable opening at a rear face of the garment;

sleeve seams joining the first sleeve edges to the second sleeve edges on each sleeve portion;

inseams joining the first leg edges to the second leg edges on each body side; and a back seam joining the top sleeve portion edge of the right sleeve portion at approximately the top body side edge of the right body side and the top sleeve portion edge of the left sleeve portion at approximately the top body side edge of the left body side, the back seam being located at the rear face of the garment.

2. The protective garment of claim 1, wherein the closure means is selected from a group consisting of zippers, button fasteners, clip fasteners, snap fasteners and hook and loop fasteners, resealable tapes, zip-lock fasteners, magnetic fasteners and combinations thereof.

3. The protective garment of claim 1, wherein the closure means is adapted to join only a portion of the torso edge of right body side to only a portion of the torso edge of the left body side to form a resealable opening at a rear face of the garment, and the protective garment further includes a seam joining a portion of the torso edge of the right body side to a portion of the torso edge of the left body side, the seam being located at the rear face of the garment.

4. The protective garment of claim 1, wherein the garment is adapted to be liquid resistant.

5. The protective garment of claim 1, wherein the garment is adapted to be breathable.

6. The protective garment of claim 1, wherein the seamless sheet of material is selected from a group consisting of a bonded carded web, a web of spunbonded fibers, a web of meltblown fibers, and a film.

7. The protective garment of claim 6, wherein the seamless sheet of material is formed from a polymer selected from a group consisting of polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins, and mixtures and blends of the same.

8. The protective garment of claim 7, wherein the polyolefin is selected from a group consisting of polyethylene, polypropylene, polybutene, ethylene copolymers, propylene copolymers and butene copolymers.

9. The protective garment of claim 1, wherein the seamless sheet of material comprises a laminate.

10. The protective garment of claim 9, wherein the laminate is selected from a group consisting of a laminate of at least one web of spunbonded fibers and at least one web of meltblown fibers and mixtures thereof.

11. The protective garment of claim 9, wherein the laminate is composed of at least one nonwoven web and at least one film layer.

12. The protective garment of claim 11, wherein the seamless sheet of material includes at least one film layer made of a polymer selected from a group consisting of polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins.

13. The protective garment of claim 12, wherein the film layer is a polyolefin selected from a group consisting of polyethylene, polypropylene, polybutene, ethylene copolymers, propylene copolymers and butene copolymers.

14. The protective garment of claim 12, wherein the laminate includes a film layer having a thickness ranging from about 0.25 mil to about 5.0 mil.

15. The protective garment of claim 1, wherein the seamless sheet of material has a basis weight ranging from about 15 gsm to about 300 gsm.

16. The protective garment of claim 15, wherein the seamless sheet of material has a basis weight ranging from about 20 gsm to about 75 gsm.

17. The protective garment of claim 1 further comprising elasticizing means on portions of the garment.

18. The protective garment of claim 1 further comprising features selected from a group consisting of vents, zipper flaps, glove cuffs, boot cuffs, air inlets, hood cuffs, collars, and mechanical fastening means and devices for attaching boots, hoods and/or gloves.

19. The protective garment of claim 1, wherein the seams are selected from a group consisting of sewn seams, stitched seams, ultrasonically bonded seams, solvent welded seams, adhesively bonded seams, taped seams, and thermally bonded seams.

20. A method of making a rear entry, protective garment, the method comprising:

providing a body piece composed of a seamless sheet of material, said body piece including:

a right body side and a left body side, each body side having a first and second leg edge, a torso edge and a top body side edge extending approximately halfway across each body side from the respective torso edge;

a right sleeve portion and a left sleeve portion, each sleeve portion having a first and second sleeve edge, and a top sleeve portion edge; and folding each body side substantially in half down their lengths;

attaching the first leg edge to the second leg edge for each body side;

folding each sleeve portion substantially in half down its length;

attaching the first sleeve edge to the second sleeve edge for each sleeve portion;

attaching the top sleeve portion edge of the right sleeve portion at approximately the top body side edge of the right body side and the top sleeve portion edge of the left sleeve portion at approximately the top body side edge of the left body side so that a seam is located at a rear face of the garment;

attaching closure means adapted to join the torso edge of the right body side and the torso edge of the left body side to form a resealable opening at the rear face of the garment.

21. The method of making a protective garment of claim 20, wherein the step of attaching closure means joins only a portion of the torso edge of right body side to only a portion of the torso edge of the left body side to form a resealable opening at a rear face of the garment, and wherein the method further includes the step of attaching the remaining portion of the torso edge of the right body side to the remaining portion of the torso edge of the left body side so that a seam is at a rear face of the coverall.

22. The method of a making protective garment according to claim 20, further comprising the steps of attaching features selected from a group consisting of a collar, a hood, boots, expandable back, vents, elastic cuffs, zipper flaps, glove cuffs, boot cuffs, air inlets, hood cuffs, and mechanical fastening means and devices for attaching boots, hoods and/or gloves.

23. The method of making a protective garment according to claim 20, wherein the attaching technique is selected from a group consisting of sewing, stitching, taping, ultrasonic bonding, solvent welding, adhesive bonding and thermal bonding.

24. A protective garment comprising:

a body piece composed of a single seamless sheet of material, said body piece including:

a right body side and a left body side, each body side having a first and second leg edge, a torso edge and a top body side edge extending approximately halfway across each body side from the respective torso edge;

a right sleeve portion and a left sleeve portion, each sleeve portion having a first and second sleeve edge, and a top sleeve portion edge; and a seam joining the torso edge of right body side to the torso edge of the left body side, the seam being located at a rear face of the garment;

sleeve seams joining the first sleeve edges to the second sleeve edges on each sleeve portion;

inseams joining the first leg edges to the second leg edges on each body side;

a back seam joining the top sleeve portion edge of the right sleeve portion at approximately the top body side edge of the right body side and the top sleeve portion edge of the left sleeve portion at approximately the top body side edge of the left body side, the back seam being located at the rear face of the garment; and closure means defining an opening at a front face of the garment and adapted to resealably join the edges of the opening together.

25. A method of making a protective garment, the method comprising:

providing a body piece composed of a seamless sheet of material, said body piece including:

a right body side and a left body side, each body side having a first and second leg edge, a torso edge and a top body side edge extending approximately halfway across each body side from the respective torso edge;

a right sleeve portion and a left sleeve portion, each sleeve portion having a first and second sleeve edge, and a top sleeve portion edge; and folding each body side substantially in half down their lengths;

attaching the first leg edge to the second leg edge for each body side;

attaching the torso edge of the right body side and the torso edge of the left body side to form a seam at the rear face of the garment;

folding each sleeve portion substantially in half down its length;

attaching the first sleeve edge to the second sleeve edge for each sleeve portion;

attaching the top sleeve portion edge of the right sleeve portion at approximately the top body side edge of the right body side and the top sleeve portion edge of the left sleeve portion at approximately the top body side edge of the left body side so that a seam is located at a rear face of the garment; and attaching closure means adapted to define an opening at a front face of the garment and adapted to resealably join the edges of the opening together.

* * * * *